US005652080A

United States Patent [19]

Yoshino et al.

[11] Patent Number: 5,652,080

[45] Date of Patent: Jul. 29, 1997

[54] METHODS AND APPARATUS TO DUPLICATE IMAGES ON VARIOUS IMAGE CARRYING MEDIA USING LIQUID CARRIER BASED DEVELOPER

[75] Inventors: Mie Yoshino, Kawasak; Makoto Obu; Takeo Tsukamoto, both of Yokohama, all of Japan

[73] Assignee: Ricoh Co., Ltd., Tokyo, Japan

[21] Appl. No.: 466,063

[22] Filed: Jun. 6, 1995

[30] Foreign Application Priority Data

| | | | |
|---|---|---|---|
| Jun. 14, 1994 | [JP] | Japan | 6-00317 |
| Jul. 25, 1994 | [JP] | Japan | 6-01477 |
| Feb. 28, 1995 | [JP] | Japan | 6-05007 |

[51] Int. Cl.[6] ..... G03G 15/16; G03G 13/10

[52] U.S. Cl. ..... 430/119; 430/126; 399/240

[58] Field of Search ..... 430/117, 119, 430/126; 399/58, 240

[56] References Cited

U.S. PATENT DOCUMENTS

| | | | |
|---|---|---|---|
| 5,028,964 | 7/1991 | Landa et al. | 355/273 |
| 5,276,492 | 1/1994 | Landa et al. | 355/277 |
| 5,304,451 | 4/1994 | Felder et al. | 430/137 |
| 5,426,491 | 6/1995 | Landa et al. | 355/256 |
| 5,436,706 | 7/1995 | Landa et al. | 430/117 |
| 5,442,427 | 8/1995 | Day | 430/117 |

FOREIGN PATENT DOCUMENTS

| | | |
|---|---|---|
| 63-178277 | 7/1988 | Japan . |

*Primary Examiner*—John Goodrow

*Attorney, Agent, or Firm*—Woodcock Washburn Kurtz Mackiewicz & Norris LLP

[57] ABSTRACT

The current invention discloses methods and devices for duplicating images on image-carrying media of various characteristics using a liquid carrier based developer. The various characteristics of the image-carrying media include absorbency, surface smoothness and coating materials. In order to render an optimal image, these surface characteristics require the adjustments of certain operational parameters related to steps or components of the duplication using the liquid carrier based developer. Among other things, a step of packing toner particles or a toner particle packing means and a step of transferring toner particles or a transfer means were adjusted alone or in combination with other steps or components. The adjustments of these two operational parameters significantly improve the rendered image quality on an image-carrying medium.

67 Claims, 10 Drawing Sheets

METHODS AND APPARATUS TO DUPLICATE IMAGES ON VARIOUS IMAGE CARRYING MEDIA USING LIQUID CARRIER BASED DEVELOPER

FIELD OF THE INVENTION

The current invention is generally related to methods and devices to render an image on various kinds of image-carrying media using a liquid carrier based developer, and more particularly, relates to the methods and devices for adjusting operational parameters for the image reproduction using the liquid carrier based developer so as to render an optimal image on a selected image-carrying medium used in copiers, printers and the like.

BACKGROUND OF THE INVENTION

In general, an image reproduction apparatus reproduces images on an image-carrying medium by transferring developer containing toner particles onto the medium in relation to a given image. Such transfer is typically achieved through the use of a developing unit which places toner or developer on the image-carrying medium via a photoreceptor drum. To accomplish image transfer, the photoreceptor drum surface is first prepared by an electrophotographic image process to selectively accept toner in relation to the image. The developing unit then applies toner onto the photoreceptor drum via a developing roller. Toner representing the desired image on the photoreceptor drum is transferred onto an image-carrying medium such as paper. Further processing of the paper, for example, the application of heat, serves to permanently adhere the toner particles to the paper.

High resolution images may be developed with a liquid carrier based developer, also known as a wet developer. The wet developer contains liquid carrier and micro toner particles suspended in the liquid carrier. To develop a high resolution image on an image-carrying medium, the liquid carrier based developer is applied from a developing roller to the photoreceptor drum according to an image pattern. The applied developer on the photoreceptor drum forms a layer having a depth ranging from approximately 30 μm to approximately 200 μm. The toner particles in the liquid carrier are ultimately transferred onto an image-carrying medium such as paper by applying a predetermined voltage to the transfer roller which holds the image-carrying medium. During this transfer, the liquid carrier facilitates the electrophoresis of toner particles by serving as a conduit between the photoreceptor drum surface and an image-carrying medium. Since the toner particle size in the liquid carrier based developer is approximately 0.1 to 0.5 μm in diameter in comparison to approximately a 5 μm toner particle in a dry developer, the above-described wet developer generally produces higher resolution images.

During the toner transfer onto an image-carrying medium, the amount of the liquid carrier for a particular image forming surface affects the image quality on that image-carrying medium. If the liquid carrier amount is excessive, as shown in FIG. 1A, for example, a portion of toner particles 24 is washed away from a body of toner particles 22 representing a line on a image-carrying medium 20. The resulted image is generally blurred. When the line 22 is seen in a cross sectional view taken at A—A, FIG. 1B illustrates the washed away toner particles 24 beside the line 22. On the other hand, if the liquid carrier amount is insufficient, an adequate amount of toner particles may not be transferred onto the image-carrying medium and the image generally suffers from light or even white spots. To improve the above-described undesirable images, the amount of liquid carrier on the photoreceptor drum needs to be adjusted based upon the image-carrying surface. For reducing the excess liquid carrier, the liquid carrier reduction means is used.

The excess carrier liquid reduction means includes a) a reverse roller also known as a squeeze roller, b) an air knife and c) a corona discharger. These means are generally located adjacent to a developing roller and a photoreceptor drum and remove an excess amount of carrier liquid after the liquid carrier based developer is applied to the photoreceptor drum. More particularly, for example Japanese Patent 63-178277 discloses that the squeeze roller is placed at a predetermined distance from the photoreceptor drum so that the squeeze roller physically contacts a portion of the carrier liquid layer placed on the photoreceptor drum. As the photoreceptor drum rotates with respect to the squeeze roller, the squeeze roller removes an excess amount of the liquid carrier from the developer layer. During this removal, the squeeze roller itself may also rotate to further control the amount of removal. In addition, the speed and/or the direction of rotation of the squeeze roller further control the amount of the liquid carrier removal.

In contrast to the above-described squeeze roller, the air knife does not physically contact the excess liquid carrier layer. After the liquid carrier based developer is applied onto the photoreceptor drum surface, the predetermined pressurized air is directed towards the excess liquid carrier surface while the photoreceptor drum is rotated and an excess amount of liquid carrier is removed by the rapid air flow.

As a third device for removing the excess liquid carrier, the corona discharger is also located at a predetermined distance from the photoreceptor drum and does not generally contact the excess liquid carrier layer. After a liquid carrier based developer is applied onto the photoreceptor drum, the corona discharger removes a predetermined excess amount of liquid carrier by discharging an ion beam towards the excess liquid carrier surface on the rotating photoreceptor drum. Since the ion beam has the same polarity as the liquid carrier, due to the repulsion, the liquid carrier is removed from the rotating photoreceptor drum surface.

In summary, any one of the above-described excess carrier liquid reduction means removes a fixed predetermined amount of carrier liquid for a single image-carrying medium. In order to render an optimal image, a right amount of liquid carrier is important for the reproduction process using a liquid carrier based developer.

In addition to the above-described liquid carrier adjustment problems, another disadvantage of using a liquid carrier based developer is that the straight edges in the rendered image are often deformed as illustrated in FIG. 2A. Referring to FIG. 2B, a cross section taken at B—B illustrates a distorted or collapsed straight edge 26. In other words, the toner particles in the vicinity of the straight edges are not held together to form a straight line. As a result, the straight line 22 appears to zigzag. The collapsed straight edge 26 generally occurs in any direction with respect to images or characters, but it appears that the collapsed edges occur more often in the trailing side of the moving direction as the image is rendered on the image-carrying medium. It is not clear as at which step of the reproduction process these toner particles near the straight edge break loose and collapse on the image-carrying medium surface.

In recent years, using a wet developer, high resolution images are in demand on various types of paper. These various types of paper present different image forming surfaces whose characteristics include smoothness and liquid absorbency. These surface characteristics affect the images produced by the liquid carrier based developer. Since each of these surface characteristics has a spectrum of degrees, there is a large number of combinations to define an image forming surface. However, a generalization of these paper types may be made in relation to the images produced by a liquid carrier based developer. In general, relatively absorbent and rough paper requires a larger amount of liquid carrier based developer than relatively unabsorbent and smooth paper. This is because liquid carrier is more easily absorbed by the paper so that more developer is necessary to ascertain a transfer of a sufficient amount of toner particles onto an image-carrying medium. On the other hand, a smooth or coated paper does not require as much wet developer since the image-carrying surface does not absorb the liquid carrier during toner particle transfer.

In contrast to a single predetermined paper type, the copying technology requires a method and an apparatus to accommodate various paper types in a single reproduction machine using a high-resolution liquid carrier based developer. Although the above-described duplicator system such as Indigo EP-100 is commercially available, the system is generally expensive and physically large due to the use of an intermediate transfer roller. The intermediate transfer roller enables the use of various type of image-carrying media since it generates a toner-containing film layer. When this film layer is transferred onto the image-carrying medium, it is not generally affected by the image forming surface characteristics to form an optimal image. However, without such an expensive intermediate transfer roller, as described above, the wet developer presents at least two types of problems including an excess liquid carrier removal and toner particle collapses. The technology requires commercially viable solutions to these problems so as to reproduce inexpensive high-resolution images using a wet developer.

SUMMARY OF THE INVENTION

To solve the above problems, one preferred embodiment of the current invention comprises a method of preventing edge collapses in an image rendered on an image-carrying medium via a photoreceptor drum using a wet developer which contains liquid carrier and toner particles suspended in the liquid carrier. The method includes the following steps of a) applying the wet developer on the photoreceptor drum and b) packing the toner particles on the photoreceptor drum so that a distance between the toner particles is reduced, whereby the toner particles on edges are substantially prevented from collapsing when the toner particles are transferred onto the image-carrying medium.

According to a second aspect of the current invention, a method is provided which adjusts the amount of a liquid carrier based developer containing toner particles and a liquid carrier for reproducing an image on one of a selected group of predetermined image-carrying media in an image reproduction system. Each of the predetermined image-carrying media provides varying image reproduction surface characteristics. The image reproduction system includes a developing roller, a photoreceptor drum and a transfer roller. The method includes the following steps of a) selecting one of the predetermined image-carrying media; b) applying onto the photoreceptor drum the developer according to the image to be reproduced, the toner particles being placed approximately at a predetermined distance from each other; c) removing a first predetermined amount of the developer from the photoreceptor drum; and d) reducing the predetermined distance between the toner particles, whereby the image created by the toner particles when transferred on the selected image-carrying medium is optimized.

According to a third aspect of the current invention, a method is provided which adjusts the amount of a liquid carrier based developer containing toner particles and a liquid carrier for reproducing an image on one of a selected group of predetermined image-carrying media in an image reproduction system. Each of the predetermined image-carrying media provides varying image reproduction surface characteristics. The image reproduction system includes a developing roller, a photoreceptor drum and a transfer roller. The method includes the following steps of a) selecting one of the predetermined image-carrying media; b) applying onto the photoreceptor drum the developer according to the image to be reproduced, the toner particles being placed approximately at a predetermined distance at each other; and c) transferring the developer from the photoreceptive drum onto the image-carrying medium on the transfer roller based upon the selected image-carrying medium, whereby the image is optimized due to an appropriate amount of the toner for the selected image-carrying medium.

According to a fourth aspect of the current invention, a method is provided which adjusts the amount of a liquid carrier based developer containing a liquid carrier and toner particles for reproducing an image on one of a group of image-carrying media in an image reproduction system. Each of the predetermined image-carrying media provides varying image reproduction surface characteristics. The image reproduction system includes a photoreceptor drum and a transfer roller. The method includes the following steps of a) selecting one of the predetermined image-carrying media; b) applying onto the photoreceptor drum the developer containing a first predetermined amount of the liquid carrier, the toner particles being placed at an approximately predetermined distance at each other; c) removing a second predetermined amount of the liquid carrier from said developer on said photoreceptor drum; d) further removing a third predetermined amount of the liquid carrier remaining after the step c) based upon the selected image-carrying medium so as to reduce the predetermined distance between the toner particles; and e) transferring the developer from the photoreceptive drum onto the image-carrying medium on the transfer roller based upon the selected image-carrying medium.

According to a fifth aspect of the current invention, a method is provided which adjusts the amount of a liquid carrier based developer containing toner particles and a liquid carrier for reproducing an image on one of a selected group of predetermined image-carrying media in an image reproduction system. Each of the predetermined image-carrying media provides varying image reproduction surface characteristics. The image reproduction system includes a photoreceptor drum. The method including the following steps of a) selecting one of the predetermined image-carrying media; b) applying onto the photoreceptor drum the developer for reproducing the image based upon the selected image-carrying medium, the toner particles contained therein being places at a predetermined distance with each other; c) removing a first predetermined amount of the developer from the photoreceptor drum based upon the selected image-carrying medium; and d) further removing a second predetermined amount of the liquid carrier over the toner on the photoreceptor drum based upon the selected image-carrying medium so as to reduce the predetermined distance between the toner particles, whereby the image on the selected image-carrying medium is optimized.

According to a sixth aspect of the current invention, a method is provided which adjusts the amount of a liquid carrier based developer containing toner particles and a liquid carrier for reproducing an image on one of a selected group of predetermined image-carrying media in an image reproduction system. Each of the predetermined image-carrying media provides varying image reproduction surface characteristics. The image reproduction system includes a photoreceptor drum. The method includes the following steps of a) selecting one of the predetermined image-carrying media; b) applying onto the photoreceptor drum the developer for reproducing the image based upon the selected image-carrying medium; c) removing a first predetermined amount of the developer from the photoreceptor drum based upon the selected image-carrying medium; and d) transferring the developer from the photoreceptive drum onto the selected image-carrying medium based upon the selected image-carrying medium.

According to a seventh aspect of the current invention, a method is provided which adjusts the amount of a liquid carrier based developer containing a liquid carrier and toner particles for reproducing an image on one of a group of image-carrying media in an image reproduction system. Each of the predetermined image-carrying media provides varying image reproduction surface characteristics. The image reproduction system includes a photoreceptor drum and a transfer roller. The method includes the following steps of a) selecting one of the predetermined image-carrying media; b) applying onto the photoreceptor drum the developer containing a first predetermined amount of the liquid carrier based upon the selected image-carrying medium in the step a), the toner particles contained therein being placed at a predetermined range of distance from each other; c) removing a second predetermined amount of the liquid carrier from the developer on the photoreceptor drum based upon the selected image-carrying medium; d) further removing a third predetermined amount of the liquid carrier remaining after the step c) based upon the selected image-carrying medium so as to reduce the predetermined range of distance between the toner particles; and e) transferring the developer from the photoreceptive drum onto the image-carrying medium on the transfer roller based upon the selected image-carrying medium.

According to an eighth aspect of the current invention, an apparatus is provided which prevents edge collapses in an image rendered on an image-carrying medium by a wet developer containing liquid carrier and toner particles suspended in the liquid carrier. The apparatus includes a photoreceptor drum for holding the wet developer; a developer for applying the wet developer onto the photoreceptor drum; and a toner particle stabilizer for packing the toner particles so that a distance between the toner particles is reduced, whereby the toner particle stabilizer substantially preventing the toner particles on the edge from collapsing when the toner particles are transferred onto the image-carrying medium.

According to a ninth aspect of the current invention, an apparatus is provided which reproduces an image on one of a selected group of predetermined image-carrying media using a liquid carrier based developer containing toner particles and a liquid carrier. Each of the predetermined image-carrying media provides varying image reproduction surface characteristics. The apparatus includes a medium selector for selecting one of the predetermined image-carrying media; a photoreceptor drum for holding the developer before placing the developer onto the selected image-carrying medium; a developing roller located adjacent to the photoreceptor drum for applying onto the photoreceptor drum the developer according to the image to be reproduced, the toner particles being placed at a predetermined range of distance from each other; a developer reduction means located adjacent to the photoreceptor drum for removing the developer from the photoreceptor drum; and a set roller located adjacent to the photoreceptor drum for selectively removing the liquid carrier from a portion containing the toner on the photoreceptor drum based upon the selected image-carrying medium so as to reduce the predetermined range of distance between the toner particles, whereby the image on the selected image-carrying medium is optimized.

According to a tenth aspect of the current invention, an apparatus is provided which reproduces an image on one of a selected group of predetermined image-carrying media using a liquid carrier based developer containing toner particles and a liquid carrier. Each of the predetermined image-carrying media provides varying image reproduction surface characteristics. The apparatus includes a medium selector for selecting one of the predetermined image-carrying media; a photoreceptor drum for holding the developer before placing the developer onto the selected image-carrying medium; a developing roller located adjacent to the photoreceptor drum for applying onto the photoreceptor drum the developer according to the image to be reproduced, the toner particles being placed approximately at a predetermined range of distance at each other; and a transfer roller located adjacent to the photoreceptor drum for transferring the developer from the photoreceptive drum onto the image-carrying medium based upon the selected image-carrying medium thereby transferring an appropriate amount of the developer based upon the selected image-carrying medium.

According to an eleventh aspect of the current invention, an apparatus is provided which reproduces an image on one of a group of image-carrying media using a liquid carrier based developer containing a liquid carrier and toner particles, each of the predetermined image-carrying media providing varying image reproduction surface characteristics. The apparatus includes a medium selector for selecting one of the predetermined image-carrying media; a photoreceptor drum for holding the developer before placing the developer onto the selected image-carrying medium; a developing roller located adjacent to the photoreceptor drum for applying onto the photoreceptor drum the developer containing a first predetermined amount of the liquid carrier, the toner particles being placed at a predetermined range of distance from each other; a reverse roller located adjacent to the photoreceptor drum for removing a second predetermined amount of the liquid carrier from the developer on the photoreceptor drum; a set roller located adjacent to the photoreceptor drum for further removing a third predetermined amount of the liquid carrier based upon the selected image-carrying medium so as to reduce the predetermined range of distance between the toner particles; and a transfer roller located adjacent to the photoreceptor drum for transferring the developer from the photoreceptive drum onto the image-carrying medium based upon the selected image-carrying medium.

According to a twelfth aspect of the current invention, a system is provided which reproduces an image on one of a selected group of predetermined image-carrying media using a liquid carrier based developer containing toner particles and a liquid carrier. Each of the predetermined image-carrying media provides varying image reproduction surface characteristics. The system includes a medium selector for selecting one of the predetermined image-carrying media; a photoreceptor drum for holding the developer before placing the developer onto the selected image-carrying medium; a developing roller located adjacent to the photoreceptor drum for applying onto the photoreceptor drum the developer for reproducing the image based upon the selected image-carrying medium, the toner particles being placed at a predetermined range of distance from each other; a reverse roller located adjacent to the photoreceptor drum for removing a first predetermined amount of the developer from the photoreceptor drum based upon the selected image-carrying medium; and a set roller located adjacent to the photoreceptor drum for further removing a second predetermined amount of the liquid carrier on the photoreceptor drum based upon the selected image-carrying medium so as to reduce the predetermined range of distance between the toner particles, whereby the image on the selected image-carrying medium is optimized.

According to a thirteenth aspect of the current invention, a system is provided which reproduces an image on one of a selected group of predetermined image-carrying media using a liquid carrier based developer containing toner particles and a liquid carrier. Each of the predetermined image-carrying media provides varying image reproduction surface characteristics. The system includes a medium selector for selecting one of the predetermined image-carrying media; a photoreceptor drum for holding the developer before placing the developer onto the selected image-carrying medium; a developing roller located adjacent to the photoreceptor drum for applying onto the photoreceptor drum the developer for reproducing the image based upon the selected image-carrying medium; a reverse roller located adjacent to the photoreceptor drum for removing a first predetermined amount of the developer from the photoreceptor drum based upon the selected image-carrying medium; and a transfer roller located adjacent to the photoreceptor drum for transferring the developer from the photoreceptive drum onto the selected image-carrying medium based upon the selected image-carrying medium.

According to a fourteenth aspect of the current invention, a system is provided which reproduces an image on one of a group of image-carrying media using a liquid carrier based developer containing a liquid carrier and toner particles. Each of the predetermined image-carrying media provides varying image reproduction surface characteristics. The system includes a medium selector for selecting one of the predetermined image-carrying media; a photoreceptor drum for holding the developer before placing the developer onto the selected image-carrying medium; a developing roller located adjacent to the photoreceptor drum for applying onto the photoreceptor drum the developer containing a first predetermined amount of the liquid carrier based upon the selected image-carrying medium, the toner particles contained therein being placed at a predetermined range of distance from each other; a reverse roller located adjacent to the photoreceptor drum for removing a second predetermined amount of the liquid carrier from the developer on the photoreceptor drum based upon the selected image-carrying medium; a set roller located adjacent to the photoreceptor drum for further removing a third predetermined amount of the liquid carrier based upon the selected image-carrying medium so as to reduce the predetermined range of distance between the toner particles; and a transfer roller located adjacent to the photoreceptor drum for transferring the developer from the photoreceptive drum onto the image-carrying medium on the transfer roller based upon the selected image-carrying medium.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENTS

Figure 1A:
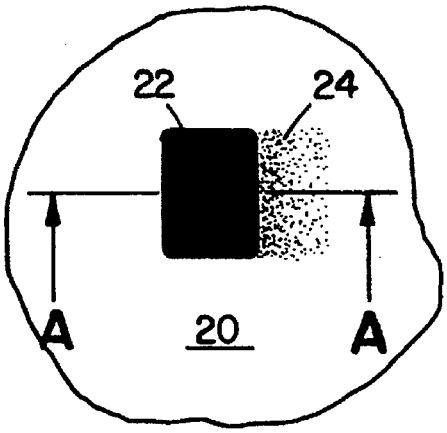
FIG. 1A is a plan view of a portion of an image which is rendered on an image-carrying medium with a liquid carrier based developer and illustrates some washed away toner particles due to an excess amount of the liquid carrier for the image carrying medium.
Figure 1B:
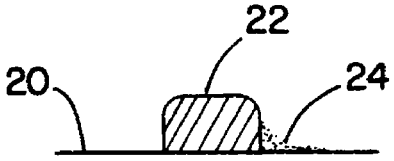
FIG. 1B is a cross sectional view of FIG. 1A taken at a line A—A and viewed in a direction indicated by the arrows.
Figure 2A:
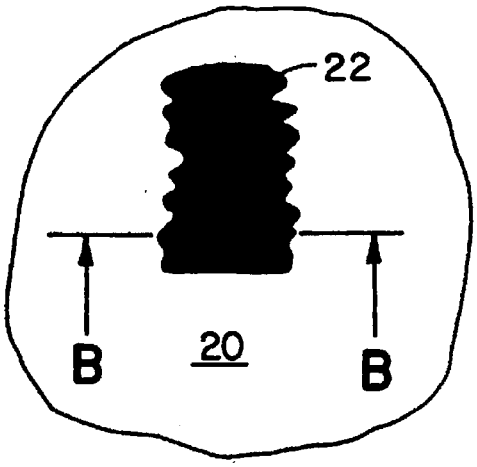
FIG. 2A is a plan view of a portion of an image which is rendered on an image-carrying medium with a liquid carrier based developer and illustrates some collapsed toner particles near an edge.
Figure 2B:
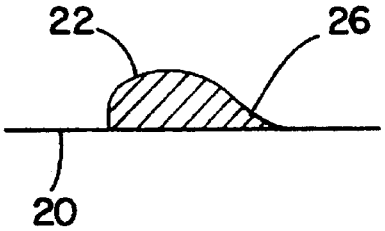
FIG. 2B is a cross sectional view of FIG. 2A taken at a line B—B and viewed in a direction indicated by the arrows.
Figure 3:
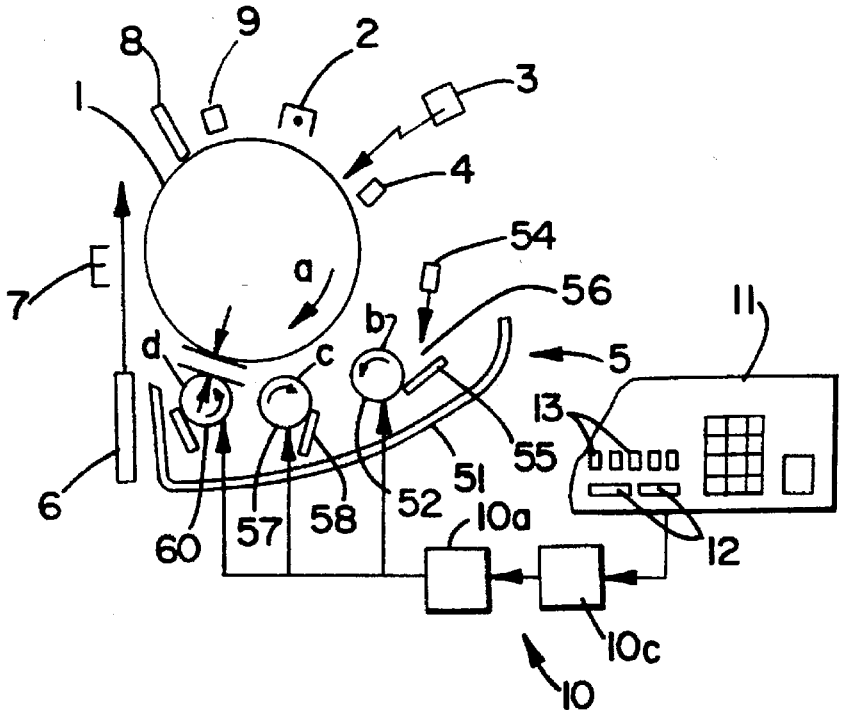
FIG. 3 is a schematic diagram illustrating one preferred embodiment of a photocopier according to the current invention for adjusting operational parameters of the liquid carrier based developing processes based upon an image carrying medium.

Referring now to the drawings, wherein like reference numerals designate corresponding structure throughout the views, and referring in particular to FIG. 3, a photoreceptor drum 1 rotates at a predetermined angular velocity in a clockwise direction as indicated by an arrow during a photocopying operation to reproduce an image on an image-carrying medium. In general, a main charger 2 uniformly charges an outer surface of the photoreceptor drum 1 housed in a dark closed housing (not shown). A laser scanner 3 removes a portion of the charge on the photoreceptor drum 1 that does not correspond to a scanned image to be reproduced. The prepared photoreceptor drum surface 1 further rotates to the a liquid carrier developing apparatus 5. When the image is developed via toner by the developing apparatus, the toner image is transferred to an image-carrying medium 6 by a transfer charger 7.

In particular, according to one embodiment of the current invention, the developing apparatus 5 includes a developing roller 52, a reverse roller 57 and a set roller 60. All of these rollers are juxtaposed to the photoreceptor drum 1 and are housed in a developing container 51. A developer supply outlet 54 provides a liquid carrier based or wet developer to the developing roller 52. The wet developer generally contains liquid carrier and toner particles suspended in the liquid carrier.

The developing roller 52 rotates in a counter clockwise direction as shown by an arrow b and applies the liquid carrier based developer onto the outer surface of the photoreceptor drum 1. Before this application, the supplied wet developer is initially reserved in an area 56 created by the developing roller 52 and a scrubber 55 and then applied to the developing roller surface. As the wet developer is applied to the photoreceptor drum surface, a voltage is applied to the developing roller 52 so as to charge the toner. The charged toner is prevented from attaching to a portion of the receptor drum surface that is not to be visualized.

To accommodate various types of paper, the amount of the wet developer to be applied on the photoreceptor drum 1 may be adjusted by varying a voltage applied to the developing roller 52 or by varying the rotation speed of the developing roller 52. In the alternative, the wet developer may be varied to contain different concentrations of toner particles with respect to the liquid carrier. According to one embodiment of the current invention, still referring to FIG. 3, the developing roller 52 is optionally connected to a controller 11 to adjust the amount of developer application to the photoreceptor drum 1 based upon image-carrying medium surface characteristics. One preferred embodiment of the controller 11 includes indicators 13 and control switches 12 and is connected to a regulator means 10*a* and 10*c* to adjust, for example, a motor speed of the developing roller. According to this embodiment, a human operator of the photocopying system specifies an image-carrying medium by pressing a switch corresponding to the image-carrying medium. However, although not shown, another embodiment of the controller 11 is optionally connected to a sensor which detects a particular feeder tray containing an image-carrying medium of a predetermined type. In this second embodiment, the human operator does not have to indicate a particular image-carrying medium. Based upon the detected signal, the sensor controls an operational parameter of the developing roller to adjust the developer application.

After the wet developer is applied to the photoreceptor drum surface, a liquid carrier reduction means such as a reverse roller or a squeeze roller 57 removes an excess amount of liquid carrier from the wet developer based upon a image-carrying medium. As shown in FIG. 3, the reverse roller 57 rotates in a clockwise direction as indicated by an arrow c, and the reverse roller 57 generally contacts the applied wet developer layer as it removes the excess liquid carrier. A scrubber 58 abuts the reverse roller 57 to clean the removed liquid carrier off the reverse roller 57. The amount of liquid carrier to be removed by the reverse roller 57 is usually determined by the following factors: the distance between the reverse roller and the photoreceptor drum, the reverse roller rotation speed and the reverse roller rotation direction with respect to the photoreceptor drum rotation direction. In order to accommodate various paper types, one or more of the above factors is varied to remove a desirable amount of liquid carrier from the photoreceptor drum 1.

The above-described controller 11 is optionally connected to the reverse roller 57 to adjust the amount of the liquid carrier removal based upon the image-carrying medium. The controller 11 may vary one or more the above-described factors to adjust the amount of the liquid carrier removal. For example, to remove more liquid carrier, the controller adjusts the rotational speed to a higher speed.

Figure 4:
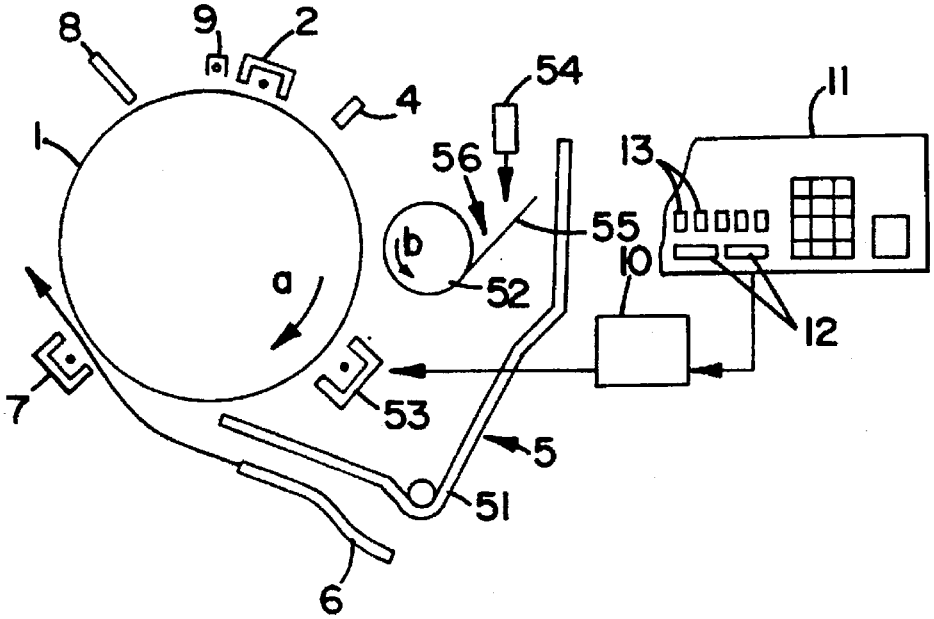
FIG. 4 is a first alternative embodiment for adjustable liquid carrier reduction means according to the current invention.

Referring to FIG. 4, a corona discharger 53 is shown as a first alternative embodiment to the above-described squeeze roller 57. The corona discharger is placed at a predetermined distance from the photoreceptor drum surface and generates ions of the same polarity as toner located on the photoreceptor drum. When the generated ions are discharged towards the wet developer layer, liquid carrier is repelled out of the wet developer layer due to the opposing polarity of the discharged ions. FIG. 4 also shows the above-described controller 11 that is optionally connected to the corona discharger 53 to control the amount of the liquid carrier removal based upon the image-carrying medium. The controller 11 applies to the corona discharger 53 a predetermined voltage corresponding to a selected image-carrying medium.

Figure 5:
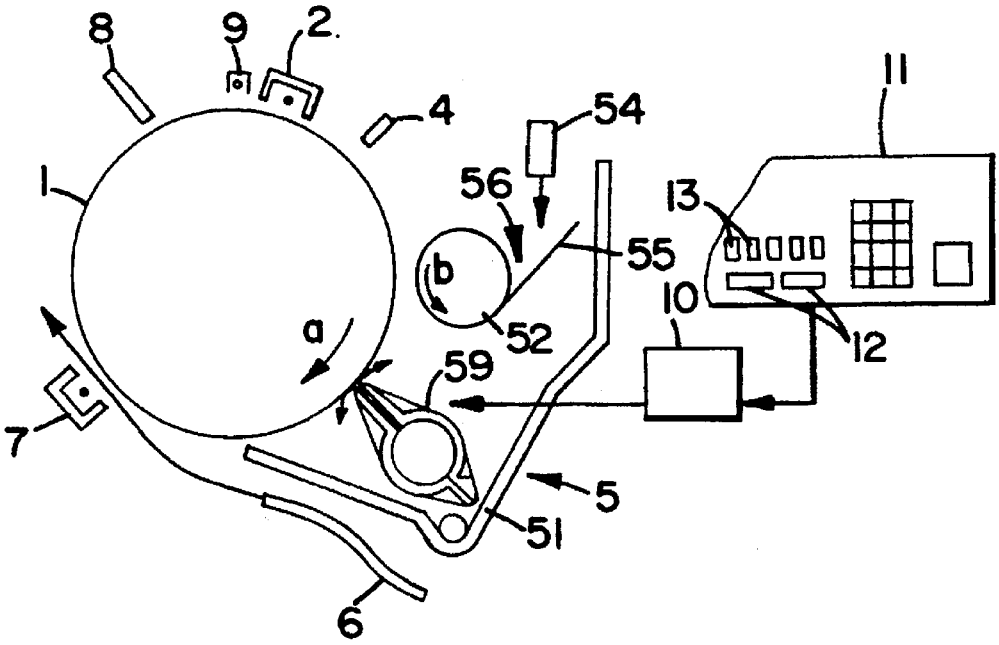
FIG. 5 is a second alternative embodiment for adjustable liquid carrier reduction means according to the current invention.

Now referring to FIG. 5, an air knife 59 is a second alternative embodiment of the liquid carrier reduction means to remove the excess amount of the liquid carrier from the wet developer applied to the photoreceptor drum 1. The air knife 59 is placed at a predetermined distance from the photoreceptor drum 1 and has an air output opening at one end which faces the photoreceptor drum 1. As the photoreceptor drum 1 rotates in the clockwise direction, a stream of compressed air is released from the opening towards the wet developer layer on the photoreceptor drum 1. By the virtue of the compressed air, a portion of the liquid carrier is blown away from the developer layer. To accommodate various types of image-carrying media, the controller 11 is optionally connected to the air knife 59 to adjust the compressed air output so as to remove a desirable amount of liquid carrier.

Referring back to FIG. 3, after an appropriate amount of liquid carrier is removed from the wet developer layer, according to one preferred embodiment of the current invention, a toner particle stabilizing means such as a set roller 60 treats the wet developer layer on the photoreceptor drum 1. Preferably, the set roller 60 is juxtaposed to the photoreceptor drum surface at a predetermined distance of 50 μm and rotates in a clockwise direction as the photoreceptor drum 1. As the set roller 60 rotates, a voltage source 10*a* applies a predetermined voltage to the set roller 60 and such an applied voltage creates a charge of the same polarity as the toner particles. The discharge from the set roller 70 treats the wet developer layer on the photoreceptor. During this treatment, in general, the toner particles in the wet developer layer are drawn closer together with each other. In other words, the distance between the toner particles is reduced after the treatment by the set roller 60. Thus, the toner particles are packed more tightly within an area where the toner particles are not closely positioned. Such a packing effect on the toner particles is beneficial to imaging edges of an image. As described in the background section, the zigzag or collapsed appearance of edges are due to the lack of firmly packed toner particles. In addition, to the above-described anti-collapsing effect, the set roller 60 also further removes a small amount of liquid carrier from the wet developer layer during the treatment.

The above-described controller 11 is optionally connected to the set roller 60 to adjust the amount of the toner particle packing based upon the image-carrying medium. For example, the controller 11 may the above-described voltage to be applied to the set roller 60 in order to adjust the toner particle packing.

Figure 6:
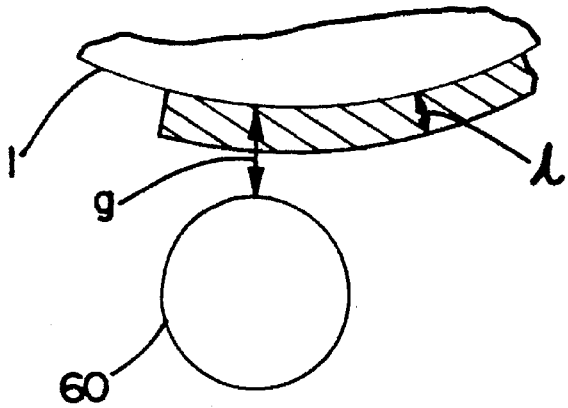
FIG. 6 is a cross sectional view of a toner particle packing means as well as a liquid carrier based developer applied on a photoreceptor drum.

Referring to FIG. 6, a cross sectional view of the photoreceptor drum 1, the set roller 60 and the wet developer layer l is shown. For one preferred embodiment of the current invention, the position of the set roller 60 with respect to the photoreceptor drum 1 is such that the distance g, preferably is larger than the thickness of the wet developer layer l which is approximately at least 15 μm so that an air gap exists between the developer surface and the set roller 60. In this preferred embodiment, the voltage for discharge to the set roller 60 is lower than an applied voltage necessary for the set roller 60 which is in contact with the wet developer layer in order to have a desirable effect of packing toner particles. Although the discharge is more stable as the air gap is smaller, the air gap in one preferred embodiment ranges from approximately 30 μm to approximately 80 μm. With the above-described air gap, the applied voltage ranges from −800 V to −300 V. The voltage may be wither AC, DC or a combination of both.

According to another embodiment of the current invention, in stead of a set roller 60, a corona discharger is used to pack the toner particles in the wet developer. The set roller 60 is also optionally connected to the controller 11 in order to adjust the amount of the packing effect on the toner particles based upon the image-carrying medium where the packed toner particles are ultimately transferred.

Figure 7A:
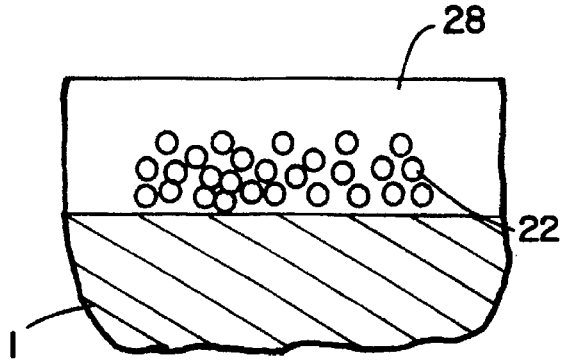
FIG. 7A is a cross sectional view illustrating a liquid carrier based developer containing toner particles applied onto a photoreceptor drum.
Figure 7B:
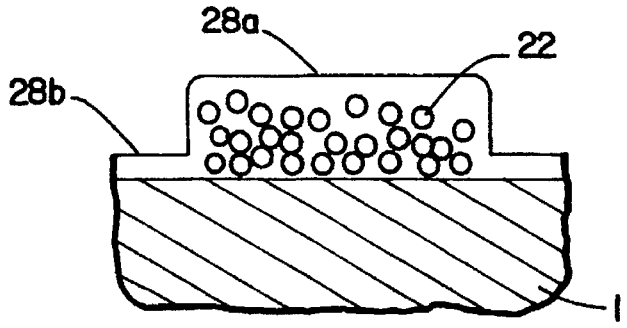
FIG. 7B illustrates a cross sectional view of the liquid carrier based developer layer of FIG. 7A after a liquid carrier reduction means removes a predetermined excess amount of the liquid carrier.
Figure 7C:
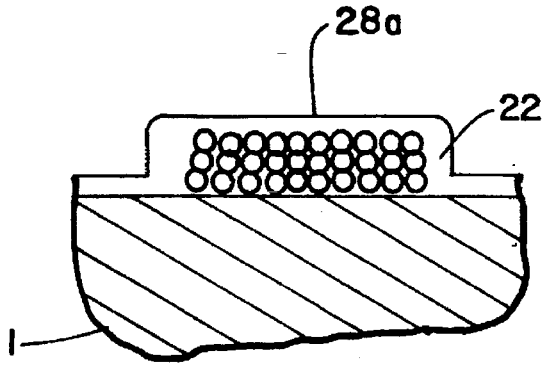
FIG. 7C illustrates a cross sectional view of the toner particles in FIG. 7B that have been packed by a toner particle packing means.

Referring to FIG. 7A–C, to summarize the effects of the above-described liquid carrier reduction means as well as the above-described toner particle stabilizing means, cross sectional views of the wet developer layer on the photoreceptor drum are illustrated. FIG. 7A illustrates a wet developer layer applied onto the photoreceptor drum surface 1. The layer contains liquid carrier 28 and toner particles 22 suspended in the liquid carrier 28.

Referring to FIG. 7B, after the reverse roller has removed a predetermined amount of excess liquid carrier, a liquid carrier portion 28*b* adjacent to the toner particles 22 is more substantially reduced than a liquid carrier portion 28*a* over the toner particles 22. At this stage, the toner particles are generally located at random at varying distances with each other.

Referring to FIG. 7C, the effect of the toner particles stabilizing means such as a set roller 60 is illustrated. The liquid carrier portion 28*a* over the toner particles 22 is further removed. At the same time, the toner particles are closely packed together. In other words, the distance between adjacent toner particles 22 is reduced. In fact, a ratio of toner particle weight to the weight of the wet developer on the photoreceptor drum surface has increased approximately by 10% to 15% after the treatment by the particle stabilizing means.

The above described toner particle stabilizing means improves the ability of the toner particles to more tightly pack among them as well as securely adhere to the photoreceptor surface. When the toner particles are applied to the photoreceptor surface, without the use of the above described toner particle stabilizing means, the applied toner particles generally tend to be diluted away from the applied location. As a result, when the toner particles are transferred onto an image-carrying medium, the size of the rendered image is smaller than the intended image size. In other words, the rendered image appears thinner than intended.

Figure 8A:
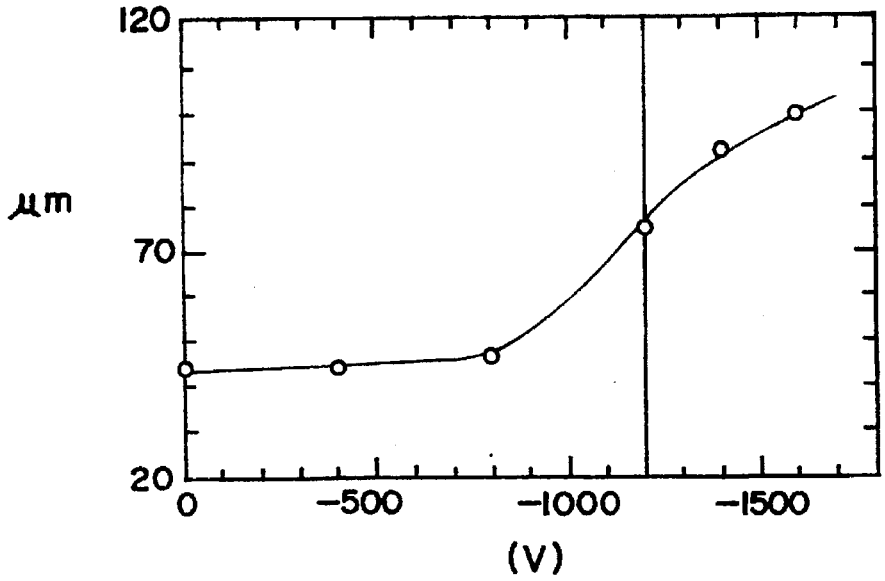
FIG. 8A illustrates that the toner packing means improves undesirable thinning of images with a wet developer.

Referring to FIG. 8A, the diameter of a dot image was measured to confirm the above described effects of the set roller on the applied toner particles. To demonstrate the above described improvement by the set roller, a dot image of a predetermined diameter is applied onto the photoreceptor surface and the reverse roller removes a predetermined excess amount of its liquid carrier. The set roller with a known voltage application further improves the pre-transfer condition of the toner particles on the photoreceptor surface. Then, the toner particles are transferred onto an image-carrying medium by applying 200 μA to a transfer roller. Thus, the rendered image on an image-carrying medium is measured with a function of the set roller applied voltage.

According to FIG. 8A, up to approximately −800 V set roller voltage, the rendered dot image size did not change as if the set roller were not used at 0 V, and at approximately −1200 V, the size of the rendered image substantially increases to approximately 75 μm from approximately 45 μm. This substantial increase indicates that the set roller improves the ability of the applied toner particles to better adhere to the photoreceptor surface and substantially eliminates freely moving toner particles detached from the applied photoreceptor location before transferring onto an image-carrying medium.

Figure 8B:
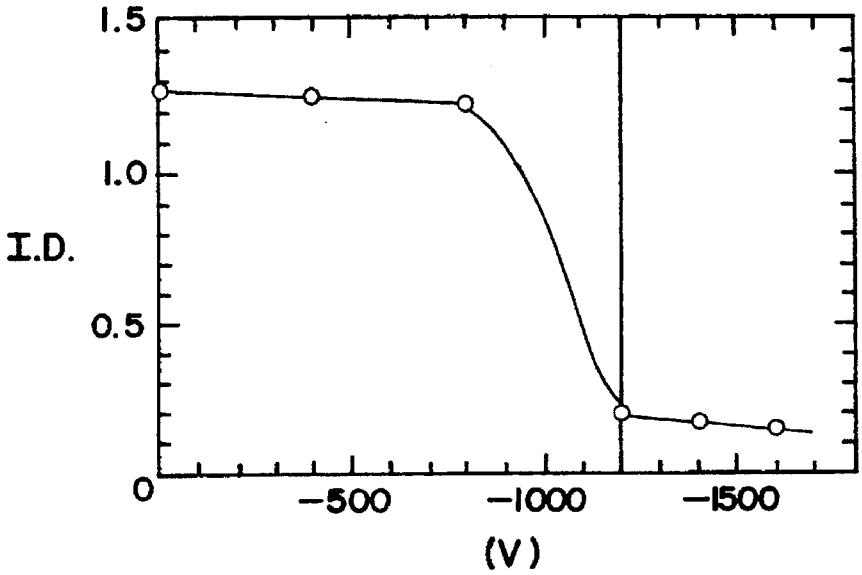
FIG. 8B illustrates another aspect of the effect of the toner packing means as described in FIG. 8A.

Referring to FIG. 8B, the effect of the set roller on an image density is illustrated. According to one preferred method to quantify an image is to measure image density (ID) using a density measuring device such as a commercially available 938 Spectrodensitometer from X-Rite. To quantify the above described effect of the set roller, the wet developer corresponding to an image of a predetermined size is applied to the photoreceptor surface, and a predetermined amount of excess liquid carrier is removed. The set roller with a known voltage application further improves the pre-transfer condition of the toner particles on the photoreceptor surface. Then, the toner particles are transferred onto an image-carrying medium which was directly pressed against the photoreceptor without applying a transfer voltage.

According to FIG. 8B, around −1200 V where the rendered image size substantially increases as shown in FIG. 8A, the image density as measured in ID substantially decreases from approximately 1.2 ID to approximately 0.2 ID. This substantial decrease reflects the improvement made by the set roller that toner particles are more securely adhered to the photoreceptor surface, and the securely adhered toner particles tend not to be transferred onto an image-carrying medium without a transfer voltage.

Referring back to FIG. 3, after the wet developer is treated by the set roller 60, a transfer charger 7 finally transfers the wet developer onto an image-carrying medium 6 such as paper on which an image is rendered. As the image-carrying medium 6 moves across the transfer charger 7, the transfer charger 7 generates ions of the opposite polarity to the toner particles on the photoreceptor drum surface 1 and applies the ions from the back of the carrying medium 6 facing the photoreceptor drum 1. When the charged carrying medium 6 is placed over the wet developer, the toner particles are transferred onto the charged carrying medium 6. To accommodate various image forming surfaces, according to a preferred embodiment of the current invention, the charger 7 is optionally connected to the controller 11 to adjust the amount of the ions applied to the image-carrying medium to optimize the rendered image quality on a selected image-carrying medium 6.

Operation of the Wet Developer Based Image Reproduction System

The above-described apparatus may be operated under certain conditions depending upon a selected image-carrying medium on which an image is to be optimally rendered. These operating conditions are determined by some characteristics of the image-carrying medium. For example, one characteristic of the image-carrying medium is a degree of smoothness on the image-forming surface of the medium. One way to quantify this surface characteristic is to measure an average height of troughs on the image-carrying medium. Another surface characteristic includes absorbency of liquid. One way to quantify the absorbency characteristic is to measure an average time for a drop of liquid carrier (approximately 0.004 ml) dripped from 5 cm above the image carrying surface to penetrate the medium until the penetrated liquid carrier is visible on the other side of the medium. Yet another surface characteristics includes an amount of coating. In general, uncoated paper is used for a black and white printing while coated paper is used for color printing. High quality paper may be coated to enhance smoothness as well as whiteness of the image forming surface.

Figure 9:
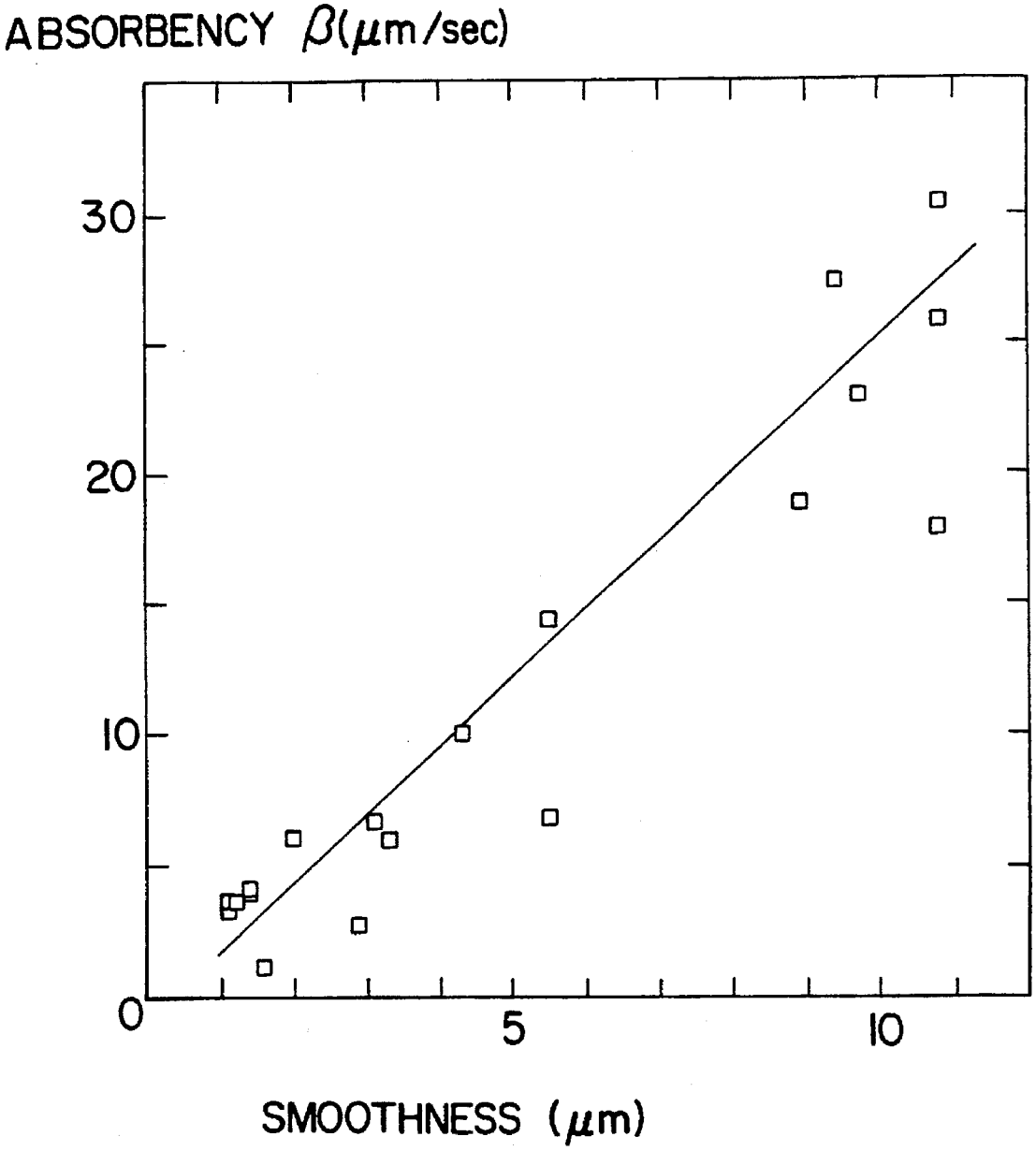
FIG. 9 illustrates a general relation between smoothness and absorbency of an image-carrying medium.

Referring to FIG. 9, a relation between the absorbency and the smoothness of an image-carrying medium is illustrated. The above defined smoothness of paper is on the X axis while the inverse of the above defined absorbency divided by the smoothness is on the Y axis. The graph illustrates a positive correlation between the smoothness and the inverse absorbency. In other words, in general, the smoother the image-carrying surface is, the less absorbent the image-carrying surface becomes. This basic relation provides a guideline for using a liquid carrier based developer on image-carrying media with various degrees of smoothness.

To accomplish an optimal image reproduction on one of the selected group of various image-carrying media using a wet developer, each or any combinations of the above-described components of the image reproduction apparatus may be adjusted according to the surface characteristics of the selected image-carrying medium. Referring to FIG. 3, according to one preferred embodiment of the current invention, the above-described components include the photoreceptor drum 1, the developing roller 52 for applying the wet developer to the surface of the photoreceptor drum 1, the reverse roller 58 for removing an excess amount of liquid carrier from the applied wet developer on the photoreceptor drum 1, the set roller 60 for stabilizing the toner particles so as to substantially reduce the toner particle collapse located near edges of an image and the transfer discharger 7 for transferring the toner particles onto the selected image-carrying medium 6 via liquid carrier. Based upon the surface characteristics of the selected image-carrying medium, each or any combination of these components may be regulated so that an optimal amount of toner is ultimately placed on the selected image-carrying medium.

During the process of the wet developer application to the photoreceptor drum, certain operating parameters are adjusted based upon a selected image-carrying medium to optimize the wet developer application. According to one preferred embodiment of the current invention, these operational parameters include the rotation speed of the developing roller, the photoreceptor drum surface voltage, the voltage applied to the developing roller, the charge carried by the toner particles in the wet developer and the concentration of the toner particles in the wet developer.

Figure 10:
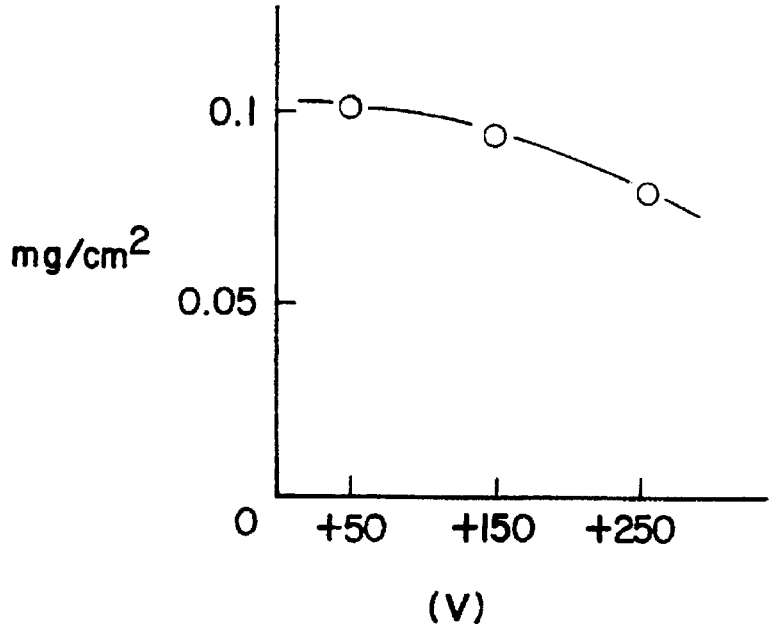
FIG. 10 illustrates a general relation between the amount of toner applied on the photoreceptor drum and a voltage applied to a developing roller when the photoreceptor drum surface voltage is kept constant.

For example, referring to FIG. 10, for regular copy paper, to apply L9-6 wet developer, the photoreceptor drum surface voltage is approximately +500 V while the developing roller voltage is approximately 250 V. The difference in the two voltages is approximately 250 V that substantially determines the 0.08 mg/cm$^2$ toner concentration weight on the photoreceptor drum and this amount of toner is sufficient for rendering an image on a relatively smooth paper. The above unit mg/cm$^2$ for toner concentration weight signifies the toner weight that is obtained after drying the applied wet developer collected from an measured area on the photoreceptor drum. However, for rough surfaced paper, more wet developer is generally necessary. Since the rough surface contains larger troughs, when the developer is ultimately applied on the image-carrying surface, the toner particles are placed in the troughs before they creates a visible image. To apply a larger toner concentration weight (0.10 mg/cm$^2$) to the photoreceptor drum surface, the voltage difference may be increased to 450 volts between the photoreceptor drum surface voltage and the developing roller voltage. Accordingly, the thickness of the wet developer layer on the photoreceptor drum ranges from approximately 30 μm to approximately 200 μm.

According to a second embodiment of the current invention, to adjust the wet developer application to the photoreceptor drum, a composition ratio of toner particle to liquid carrier may be modified. For example, for regular paper the weight ratio is approximately 1 toner particle to 8 liquid carrier. For rougher paper, the weight ratio may be increased to 2 toner particle to 8 liquid carrier. Any combination of the above-described parameters may be used to adjust the wet developer application to the photoreceptor drum.

Lastly, according to a third embodiment of the current invention, to adjust the wet developer application to the photoreceptor drum, the rotational speed of the developing roller is modified. In general, the faster the rotational speed is, the more a wet developer is applied to the photoreceptor drum.

After the developer application, an excess amount of the liquid carrier is removed from the photoreceptor drum surface. During this removal process, certain operating parameters of the liquid carrier reduction means are adjusted based upon a selected image-carrying medium so as to remove an optimal amount of the liquid carrier. For example, according to one preferred embodiment using a reverse roller, the reverse roller may be operated at a different rotational speed and/or at a different distance from the photoreceptor drum.

Figure 11:
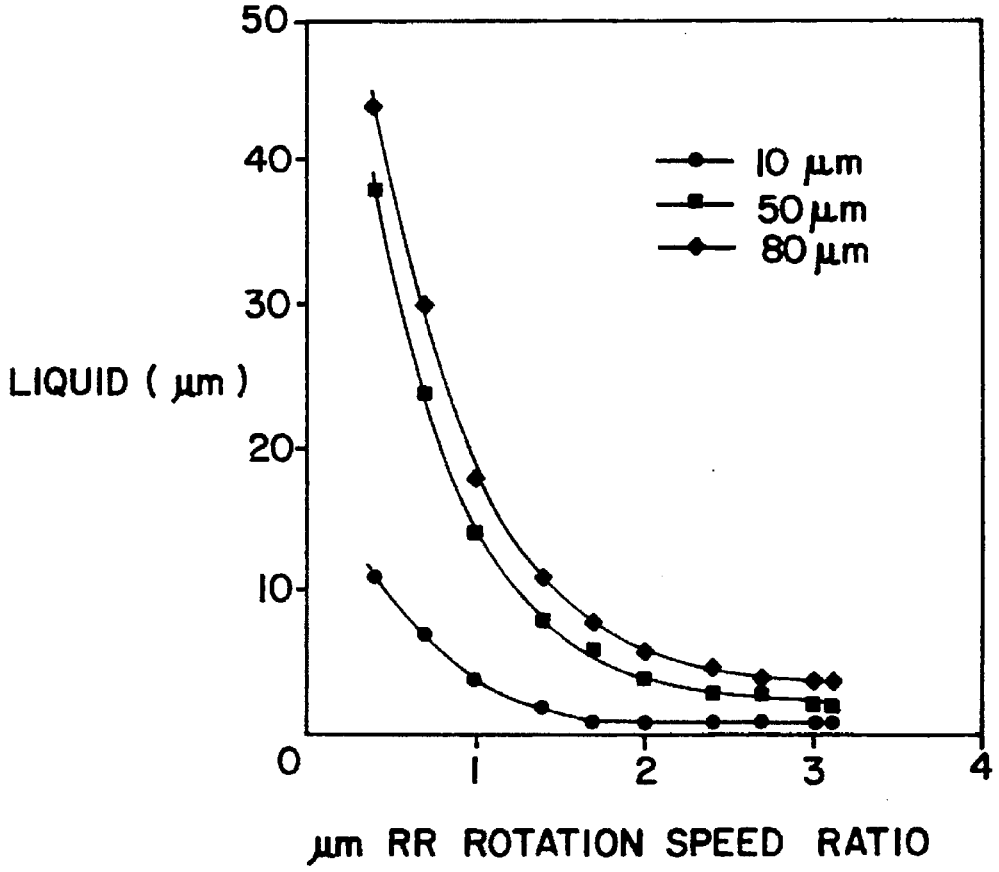
FIG. 11 illustrates a general relation between the reverse roller rotation speed ratio and the liquid carrier that is applied onto a photoreceptor drum surface at a predetermined gap between the reverse roller and the photoreceptor drum.

Referring to FIG. 11, the above two operating parameters of the reverse roller are varied when the photoreceptor drum is rotated at a constant speed of 75 mm/sec. The Y axis shows the thickness in μm of liquid carrier left on the photoreceptor drum while the X axis shows a ratio of the reverse roller rotational speed to the photoreceptor drum rotational speed. In general, as the reverse roller rotates faster, the more liquid carrier is removed from the wet developer layer on the photoreceptor drum until a certain peak speed is reached. At a higher rotational speed beyond the peak speed, the reverse roller removes less amount of liquid carrier. In addition, according to FIG. 11, more liquid carrier is removed as the distance between the reverse roller and the photoreceptor drum becomes smaller as shown for 10 μm and 80 μm.

After the liquid carrier removal before transferring onto an image-carrying medium, toner particles are packed tightly on the photoreceptor drum surface. During this packing process, certain operating parameters of the toner particle packing means such as a set roller are adjusted based upon a selected image-carrying medium to substantially prevent toner particles near edges of an image from collapsing.

Figure 12A:
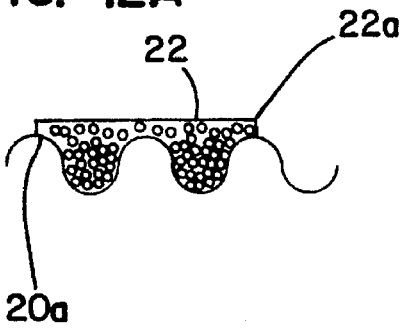
FIG. 12A is a cross sectional view illustrating how a liquid carrier based developer settles itself on a rough surfaced image carrying medium when a sufficient amount of the developer is provided.
Figure 12C:
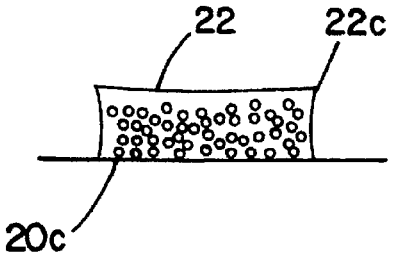
FIG. 12C is a cross sectional view of a layer of a liquid carrier based developer laid on a smooth surfaced image-carrying medium.

Generally, as shown in FIG. 12A, the rough surface 20*a* of an image-carrying medium generally provides a favorable image-forming foundation where the toner particles 22 are settled according the contour of the surface and an extended edge portion 22*a* of the toner particles above the image forming surface 20*a* is generally held firmly. In contrast, as shown in FIG. 12C, without packing the toner particles, for the approximately same amount of toner, the toner particles are laid taller above the image forming surface. In areas near edges 22*c* of an image, toner particles are generally not held tightly together and more likely to collapse. For the above-described reason, it is necessary to pack the toner particles especially before transferring them onto a smooth surfaced image forming medium.

Figure 13:
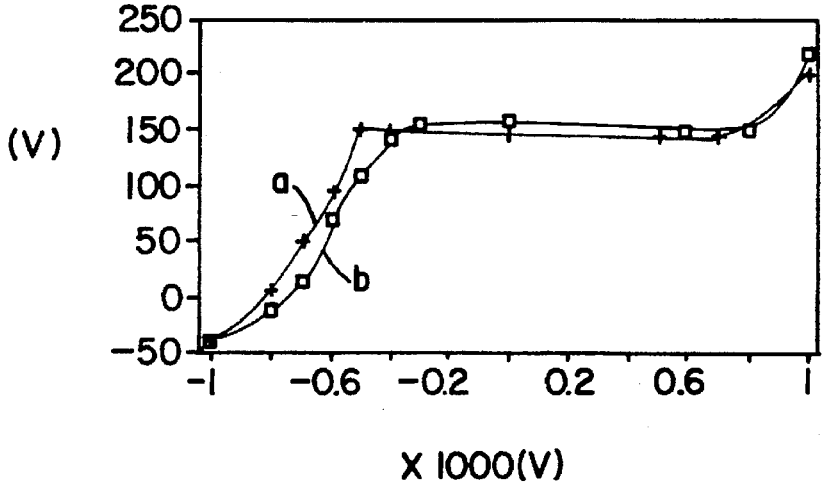
FIG. 13 illustrates a relation between the photoreceptor drum voltage and the set roller voltage in one preferred embodiment according to the current invention.

In order to control the packing process, the distance between the set roller and the photoreceptor drum and or a voltage or a current to be applied to the set roller may be adjusted according to a selected image-carrying medium. In general, a higher voltage or current is applied to the set roller for increasing the packing effect. As shown in FIG. 13, when an applied voltage on the X axis is reduced to approximately −300 V, the photoreceptor drum surface voltage on the Y axis starts decreasing from approximately 150 V. The transferred image has improved at this voltage level. However, when the applied voltage is further decreased to approximately −800 V and the photoreceptor drum surface voltage reaches almost 0 V, the image quality significantly improves by substantially eliminating collapsed edges.

Still referring to FIG. 13, the physical contact between the set roller and the wet developer layer on the photoreceptor drum also affects the packing process. The line "a" indicates measurements for a contacting situation where the set roller is in physical contact with the wet developer on the photoreceptor drum. In contrast, the line b indicates measurements for a non-contacting situation where the set roller is placed at a predetermined distance apart from the wet developer layer on the photoreceptor drum. When the photoreceptor drum surface achieves sub 0 V, the non-contacting set roller requires less voltage value as indicated by the line b in FIG. 13, and the discharge from the set roller to the photoreceptor drum surface is stable.

Figure 12B:
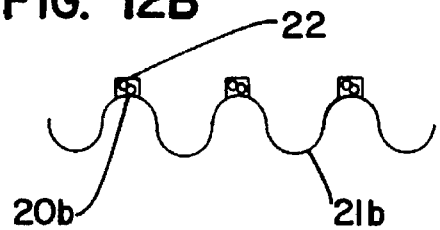
FIG. 12B is also a cross sectional view as illustrated in FIG. 12A when an insufficient amount of the developer is provided.

Lastly, during the process of the wet developer transfer from the photoreceptor drum surface to an image-carrying medium, certain operating parameters of the image transfer means are adjusted based upon a selected image-carrying medium in order to render an optimal image. Referring back to FIG. 12C, as described above, the smooth surface 20*c* generally requires less amount of toner than the rough surface 20*a* to produce images of similar quality. In fact, on the smooth surface, an excess amount of toner tends to create the above-described collapsing problem. On the other hand, on a rough image forming surface, a small amount of toner tends to cover only the peaks 20*b* and not the valleys 21*b* as shown in FIG. 12B and undesirable white spots are resulted in the image. To optimize an image, an appropriate amount of toner needs to be transferred onto a selected image-carrying medium by adjusting a voltage or a current to a transfer means such as a transfer discharger.

Figure 14:
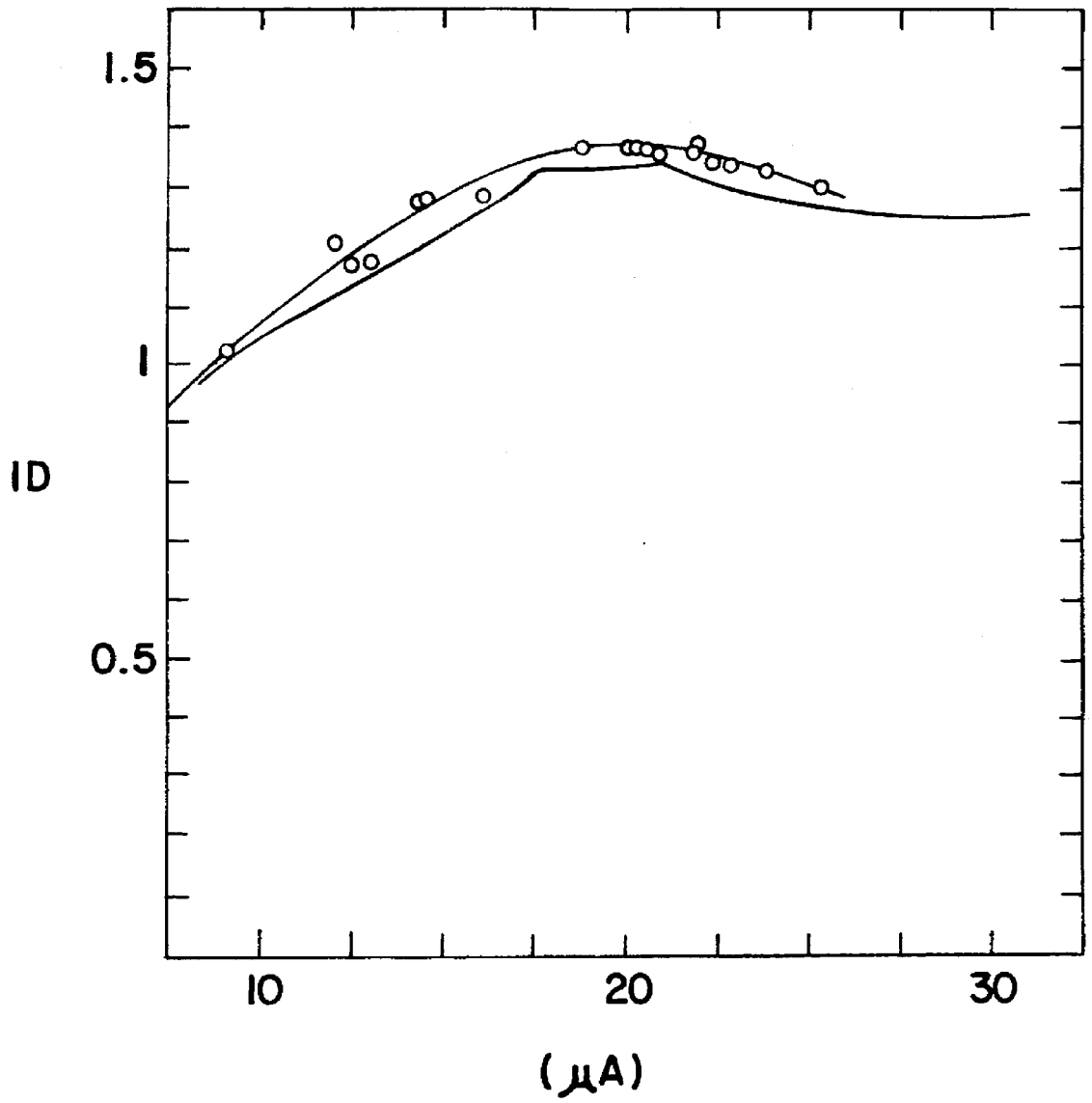
FIG. 14 illustrates the relation between the image density and the current applied to the transfer roller.

FIG. 14 illustrates the relation between the current (μA) applied to the transfer roller and the image density (ID) on the image-carrying medium. According to one preferred method to quantify an image is to measure image density (ID) using a density measuring device such as a commercially available 938 Spectrodensitometer from X-Rite. The above-described ID is positively related to the toner density on an image-carrying medium and also to the current applied to the transfer roller to a certain point. In FIG. 14, the above-described turning point is approximately 20 μA, and the toner transfer process becomes unstable over 20 μA, resulting in a decreased ID value. Thus, according to one preferred method, the current applied to the transfer roller should be below the turning point.

Figure 15:
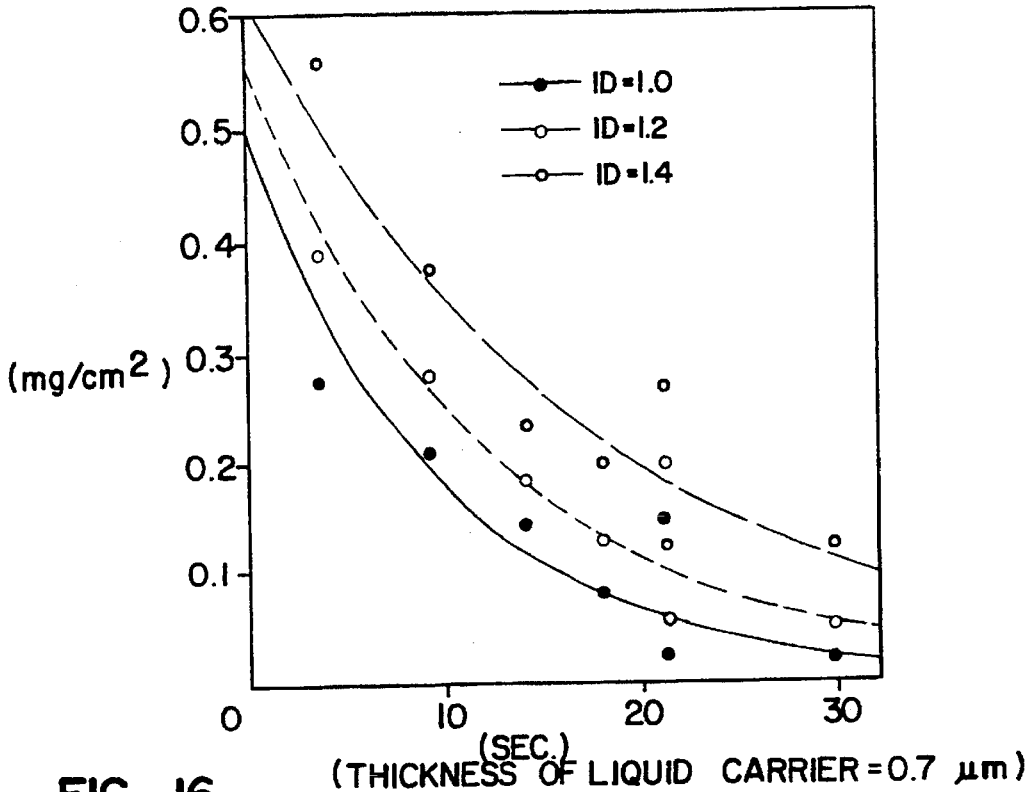
FIG. 15 illustrates one example of how the toner density in mg/cm$^2$ is determined based upon absorbency when a selected measured image density (ID) and the 0.7 μm thickness of the are kept constant.

The above-described operational parameters may be adjusted to ultimately render on a selected image-carrying medium an image at a predetermined image density. Referring to FIG. 15, the X axis indicates the absorbency of an image-carrying medium in seconds as defined above while the Y axis indicates the toner concentration weight in $mg/cm^2$ of the wet developer placed on the photoreceptor drum. The above unit $mg/cm^2$ for the toner concentration weight signifies the toner weight that is obtained after drying the applied wet developer collected from an measured area on the photoreceptor drum. When the thickness of the liquid carrier applied onto the photoreceptor drum surface is 0.7 μm, for example, in order to have an image with image density (ID) of 1.0 on an image carrying medium having the absorbency of approximately 10 seconds, approximately 0.2 $mg/cm^2$ of toner concentration weight is necessary. For a higher image density, given the same absorbency characteristics, a higher toner concentration weight is needed as shown for ID at 1.2 or 1.4.

Figure 16:
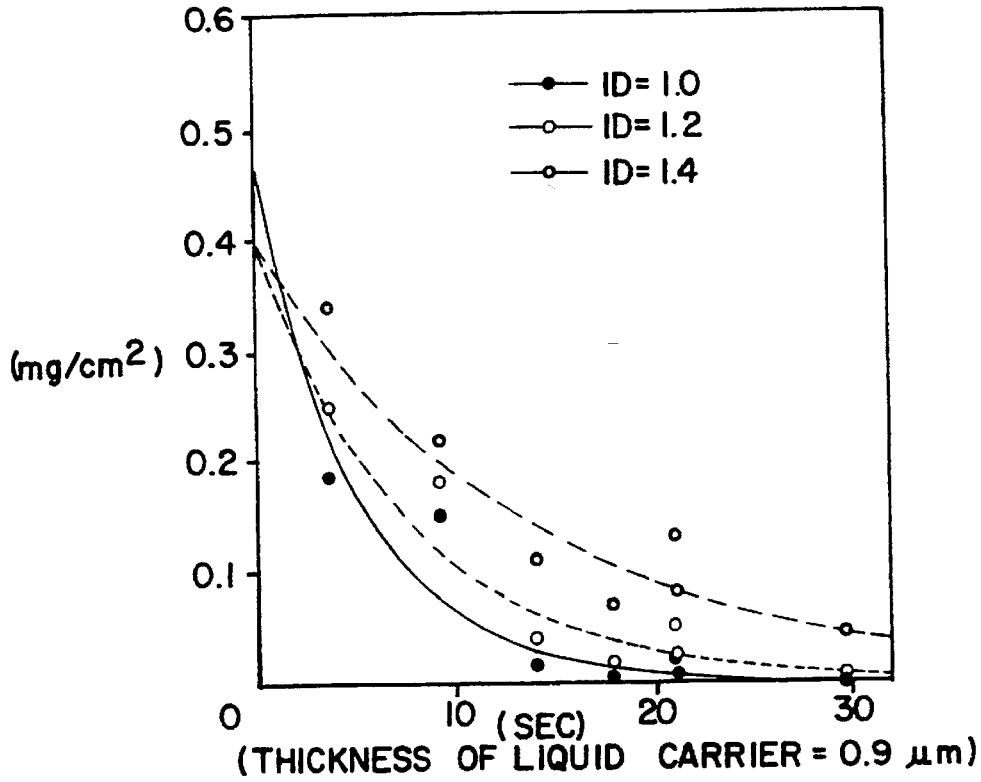
FIG. 16 illustrates one example of how the toner density in mg/cm$^2$ is determined based upon absorbency when a selected measured image density (ID) and the 0.9 μm thickness of the are kept constant.

Referring to FIG. 16, the X and Y axes have the same units as FIG. 15 while the thickness of the applied liquid carrier is 0.9 μm. In comparison to FIG. 15, in order to have the image density of 1, the image-carrying medium of 10-second absorbency requires less than 0.2 $mg/cm^2$ of toner concentration weight is necessary because of increased liquid carrier. The above reduction suggests that the same image density may be obtained with different toner concentration weights. In an example illustrated in FIG. 16, even though the toner concentration weight is lower, the same image density level is ultimately obtained on the same image forming surface by applying more wet developer to the photoreceptor drum by increasing the thickness of the applied wet developer layer.

Using the liquid carrier based developer such as R50IV from Ricoh Corp containing liquid carrier such as IsoparL of Exxon Corp, the following examples are given to compare the operational parameters for two types of image-carrying media.

EXAMPLE 1

In order to render an optimal image on a rough surface image-carrying medium such as RICOPY PPC TYPE 6000<70W> available from Ricoh Corporation having the above defined 3.6-second absorbency and the above defined 12.7 μm roughness, the following operational parameters are used:

| | |
|---|---|
| the photoreceptor drum surface voltage | 500 V |
| the reverse roller rotational speed ratio to the photoreceptor drum | 2–3 |
| the set roller current along the longitudinal axis | 1.0–2.0 μA/cm |
| the transfer discharger | 0.7–1.0 μA/cm |

EXAMPLE 2

In order to render an optimal image on a smooth surface image-carrying medium such as NK high coat available from Nihon Kako Seishi Company having 21.3 second the above defined absorbency and 2.1 μm above defined roughness, the following operational parameters are used:

| | |
|---|---|
| the photoreceptor drum surface voltage | 300 V |
| the reverse roller rotational speed ratio to the photoreceptor drum | 3–4.5 |
| the set roller current along the longitudinal axis | 1.3–3.5 μA/cm |
| the transfer discharger | 0.5–1.0 μA/c |

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of preventing edge collapses in an image rendered on an image-carrying medium via a photoreceptor drum using a wet developer which contains liquid carrier and toner particles suspended in the liquid carrier, comprising the steps of:

a) applying the wet developer on the photoreceptor drum according the image to be rendered; and b) applying a predetermined voltage to said developer from a predetermined distance through an air gap so as to pack the toner particles on the photoreceptor drum before transferring onto said image-carrying medium so that a distance between the toner particles is reduced, whereby said toner particles on edges are substantially prevented from collapsing when the toner particles are transferred onto said image-carrying medium.

2. The method of preventing edge collapses as recited in claim 1 wherein during said step b) said toner particles are packed by applying a voltage.

3. The method of preventing edge collapses as recited in claim 1 wherein during said step b) a predetermined amount of the liquid carrier is removed from the wet developer.

4. The method of preventing edge collapses as recited in claim 1 wherein during said step b) said distance between the toner particles is reduced due to approximately at least 10% increase in a ratio of a first weight of the toner particles to a second weight of the wet developer applied to the photoreceptor drum during said step a).

5. A method of adjusting an amount of a liquid carrier based developer containing toner particles and a liquid carrier for reproducing an image on one of a selected group of predetermined image-carrying media via a photoreceptor drum, each of said predetermined image-carrying media providing varying image reproduction surface characteristics, said method comprising the steps of:

a) selecting one of said predetermined image-carrying media;

b) applying onto said photoreceptor drum said developer according to said image to be reproduced, said toner particles being placed at a predetermined range of distance from each other;

c) removing a first predetermined amount of said developer from said photoreceptor drum; and d) applying a predetermined voltage to said developer from a predetermined distance through an air gap so as to reduce said predetermined range of distance between said toner particles on said photo receptor drum according to said selected image-carrying medium prior to transferring onto said selected image-carrying medium, whereby the quality of said image created by said toner particles on said selected image-carrying medium is optimized.

6. The method of adjusting an amount of a liquid carrier based developer as recited in claim 5 wherein said step d) further removes a second predetermined amount of said liquid carrier.

7. The method of adjusting an amount of a liquid carrier based developer as recited in claim 5 wherein in said step b) said developer is applied based upon said selected image-carrying medium in said step a).

8. The method of adjusting an amount of a liquid carrier based developer as recited in claim 7 wherein said selected image-carrying medium determines an amount of voltage to be applied in said step b).

9. The method of adjusting an amount of a liquid carrier based developer as recited in claim 7 wherein said selected image-carrying medium determines a ratio between said toner and said carrier liquid in said developer to be applied to said photoreceptor drum in said step b).

10. The method of adjusting an amount of a liquid carrier based developer as recited in claim 7 wherein said selected image-carrying medium determines an amount of charge on the photoreceptor drum in said step b).

11. The method of adjusting an amount of a liquid carrier based developer as recited in claim 7 wherein said selected image-carrying medium determines an amount of charge carried by the toner particles in said step b).

12. The method of adjusting an amount of a liquid carrier based developer as recited in claim 5 wherein in said step c)

said first predetermined amount of said developer is removed based upon said selected image-carrying medium.

13. The method of adjusting an amount of a liquid carrier based developer as recited in claim 12 wherein said first predetermined amount of said developer to be removed is substantially said carrier liquid.

14. The method of adjusting an amount of a liquid carrier based developer as recited in claim 13 wherein said carrier liquid is uniformly removed from said developer.

15. The method of adjusting an amount of a liquid carrier based developer as recited in claim 12 wherein said step c) is performed by a reverse roller which physically contacts said developer.

16. The method of adjusting an amount of a liquid carrier based developer as recited in claim 12 wherein said step c) is performed by applying an air towards said developer.

17. The method of adjusting an amount of a liquid carrier based developer as recited in claim 5 further comprises a step e) of transferring said developer to said selected image-carrying medium based upon said selected image-carrying medium.

18. The method of adjusting an amount of a liquid carrier based developer as recited in claim 17 wherein said developer is transferred by varying a voltage in said step d).

19. A method of adjusting an amount of a liquid carrier based developer containing toner particles and a liquid carrier for reproducing an image on one of a selected group of predetermined image-carrying media via a photoreceptor drum, each of said predetermined image-carrying media providing varying image reproduction surface characteristics, said method comprising the steps of:

a) selecting one of said predetermined image-carrying media;

b) applying onto said photoreceptor drum said developer according to said image to be reproduced, said toner particles being placed at a predetermined range of distance from each other on said photoreceptor drum; and c) applying a predetermined voltage to said developer from a predetermined distance through an air gap so as to transfer said developer from said photoreceptive drum onto said selected image-carrying medium based upon image reproduction surface characteristics of said selected image-carrying medium, whereby the quality of said image is optimized.

20. The method of adjusting an amount of liquid carrier as recited in claim 19 wherein in said step b) said developer is applied based upon said image-carrying medium as selected in said step a).

21. The method of adjusting an amount of liquid carrier as recited in claim 19 wherein said developer is applied by varying a first voltage during said step b).

22. The method of adjusting an amount of liquid carrier as recited in claim 19 wherein said developer is applied by varying a ratio between said toner and said liquid carrier in said developer in said step b).

23. The method of adjusting an amount of liquid carrier as recited in claim 19 wherein in said step c) said developer is transferred by applying a second voltage.

24. The method of adjusting an amount of liquid carrier as recited in claim 19 further comprising a first additional step between said step b) and said step c) for removing a first predetermined amount of said liquid carrier located on said photoreceptor drum based upon said selected image-carrying medium.

25. The method of adjusting an amount of liquid carrier as recited in claim 24 wherein in said first additional step said liquid carrier is removed by physically contacting said developer on said photoreceptor drum.

26. The method of adjusting an amount of liquid carrier as recited in claim 24 wherein in said first additional step said liquid carrier is removed by applying compressed air towards said developer on said photoreceptor drum.

27. The method of adjusting an amount of liquid carrier as recited in claim 24 further comprising a second additional step between said step b) and said step c) and after said first additional step for further removing a second predetermined amount of said carrier liquid on said photoreceptor drum based upon said selected image-carrying medium.

28. The method of adjusting an amount of liquid carrier as recited in claim 27 wherein said second additional step reduces said predetermined distance between said toner particles.

29. The method of adjusting an amount of liquid carrier as recited in claim 27 wherein in said second additional step said second predetermined amount of said carrier liquid is removed substantially from a portion of said developer containing said toner.

30. A method of adjusting an amount of a liquid carrier based developer containing a liquid carrier and toner particles for reproducing an image on one of a group of image-carrying media via a photoreceptor drum, each of said predetermined image-carrying media providing varying image reproduction surface characteristics, said method comprising the steps of:

a) selecting one of said predetermined image-carrying media;

b) applying onto said photoreceptor drum said developer containing a first predetermined amount of said liquid carrier, said toner particles being placed at a predetermined range of distance at each other on said photoreceptor drum;

c) removing a second predetermined amount of said liquid carrier from said developer on said photoreceptor drum prior to transferring said developer onto said image-carrying medium;

d) applying a predetermined voltage to said developer from a predetermined distance through an air gap so as to further remove a third predetermined amount of said liquid carrier remaining after said step c) based upon said selected image-carrying medium so as to reduce said predetermined range of distance between said toner particles prior to transferring said developer onto said image-carrying medium, said second amount and said third amount being smaller than said first amount; and e) transferring said developer from said photoreceptive drum onto said image-carrying medium based upon said selected image-carrying medium.

31. The method of adjusting an amount of liquid carrier as recited in claim 30 wherein in said step b), said first predetermined amount of said developer is applied based upon said selected image-carrying medium.

32. The method of adjusting an amount of liquid carrier as recited in claim 30 wherein in said step c), said second predetermined amount of said liquid carrier is removed based upon said selected image-carrying medium.

33. A method of adjusting an amount of a liquid carrier based developer containing toner particles and a liquid carrier for reproducing an image on one of a selected group of predetermined image-carrying media via a photoreceptor drum, each of said predetermined image-carrying media providing varying image reproduction surface characteristics, said method comprising the steps of:

a) selecting one of said predetermined image-carrying media;

b) applying onto said photoreceptor drum said developer for reproducing said image based upon said selected image-carrying medium, said toner particles contained therein being placed approximately at a predetermined distance with each other on said photoreceptor drum;

c) removing a first predetermined amount of said developer from said photoreceptor drum based upon said selected image-carrying medium prior to transferring said developer onto said selected image-carrying medium; and d) applying a predetermined voltage to said developer from a predetermined distance through an air gap so as to further remove a second predetermined amount of said liquid carrier over said toner on said photoreceptor drum based upon said selected image-carrying medium so as to reduce said predetermined range of distance between said toner particles prior to transferring said developer onto said selected image-carrying medium, said second amount being smaller than said first amount, whereby the quality of said image on said selected image-carrying medium is optimized.

34. A method of adjusting an amount of a liquid carrier based developer containing toner particles and a liquid carrier for reproducing an image on one of a selected group of predetermined image-carrying media via a photoreceptor drum, each of said predetermined image-carrying media providing varying image reproduction surface characteristics, said method comprising the steps of:

a) selecting one of said predetermined image-carrying media;

b) applying onto said photoreceptor drum said developer for reproducing said image based upon said selected image-carrying medium;

c) removing a first predetermined amount of said developer from said photoreceptor drum based upon said selected image-carrying medium prior to transferring said developer onto said selected image-carrying medium; and d) applying a predetermined voltage to said developer from a predetermined distance through an air gap so as to transfer said developer from said photoreceptive drum onto said selected image-carrying medium based upon said selected image-carrying medium.

35. A method of adjusting an amount of a liquid carrier based developer containing a liquid carrier and toner particles for reproducing an image on one of a group of image-carrying media via a photoreceptor drum, each of said predetermined image-carrying media providing varying image reproduction surface characteristics, said method comprising the steps of:

a) selecting one of said predetermined image-carrying media;

b) applying onto said photoreceptor drum said developer containing a first predetermined amount of said liquid carrier based upon said selected image-carrying medium in said step a), said toner particles contained therein being placed at a predetermined range of distance from each other;

c) removing a second predetermined amount of said liquid carrier from said developer on said photoreceptor drum based upon said selected image-carrying medium prior to transferring said developer onto said selected image-carrying medium;

d) applying a predetermined voltage to said developer from a predetermined distance through an air gap so as to further remove a third predetermined amount of said liquid carrier remaining after said step c) based upon said selected image-carrying medium so as to reduce said predetermined range of distance between said toner particles prior to transferring said developer onto said selected image-carrying medium; and e) transferring said developer from said photoreceptive drum onto said image-carrying medium based upon said selected image-carrying medium.

36. An apparatus for preventing edge collapses in an image rendered on an image-carrying medium by a wet developer containing liquid carrier and toner particles suspended in the liquid carrier, comprising:

a photoreceptor drum for holding the wet developer;

a developer for applying the wet developer onto said photoreceptor drum according to the image to be rendered, the applied wet developer on said photoreceptor drum having a second weight; and a toner particle stabilizer located at a predetermined distance from said photoreceptor drum for applying a predetermined voltage to said developer through an air gap towards said photoreceptor drum so as to pack the toner particles in the applied wet developer located on said photoreceptor drum so that a distance between the toner particles is reduced before the toner particles are transferred onto said image-carrying medium, the toner particles having a first weight, whereby said toner particle stabilizer substantially prevents the toner particles near the edge from collapsing when the toner particles are transferred onto said image-carrying medium.

37. The apparatus for preventing edge collapses according to claim 36 wherein said toner particle stabilizer reduces said distance between the toner particles by applying a voltage towards the toner particles located on the photoreceptor drum.

38. The apparatus for preventing edge collapses according to claim 36 wherein said toner particle stabilizer removes a predetermined amount of the liquid carrier from the wet developer.

39. The apparatus for preventing edge collapses according to claim 36 wherein said toner particle stabilizer increases approximately at least 10% of a ratio of said first weight of the toner particles to said second weight of the wet developer applied to the photoreceptor drum.

40. An apparatus for reproducing an image on one of a selected group of predetermined image-carrying media using a liquid carrier based developer containing toner particles and a liquid carrier, each of said predetermined image-carrying media providing varying image reproduction surface characteristics, said apparatus comprising:

a medium selector for selecting one of said predetermined image-carrying media, said one of said image-carrying media being a selected image-carrying medium;

a photoreceptor drum for holding said developer before placing said developer onto said selected image-carrying medium;

a developing roller located adjacent to said photoreceptor drum for applying onto said photoreceptor drum said developer according to said image to be reproduced, said toner particles being placed at a predetermined range of distance from each other;

a developer reduction means located adjacent to said photoreceptor drum for removing a predetermined amount of said developer applied onto said photoreceptor drum; and a set roller located near said photoreceptor drum for applying a predetermined voltage to said developer from a predetermined distance through an air gap so as to selectively remove said liquid carrier from an area over said toner particles placed on said photoreceptor drum according to said selected image-carrying medium so as to reduce said predetermined range of distance between said toner particles before said toner particles are transferred onto said image-carrying medium, whereby a quality of said image on said selected image-carrying medium is optimized.

41. The apparatus for reproducing an image according to claim 40 wherein said developing roller applies said developer based upon said selected image-carrying medium.

42. The apparatus for reproducing an image according to claim 40 wherein said medium selector determines a voltage to be applied to said developing roller based upon said selected image-carrying medium.

43. The apparatus for reproducing an image according to claim 40 wherein said medium selector determines based upon said selected image-carrying medium a ratio between said toner particles and said carrier liquid in said developer to be applied to said photoreceptor drum.

44. The apparatus for reproducing an image according to claim 40 wherein based upon said selected image-carrying medium said developer reduction means removes said developer located on said photoreceptor drum.

45. The apparatus for reproducing an image according to claim 44 wherein said developer reduction means removes substantially said carrier liquid.

46. The apparatus for reproducing an image according to claim 45 wherein said liquid carrier is uniformly removed from said developer.

47. The apparatus for reproducing an image according to claim 40 wherein said developer reduction means is a reverse roller which physically contacts said developer.

48. The apparatus for reproducing an image according to claim 40 wherein said developer reduction means is an air compressor which applies air towards said developer.

49. The apparatus for reproducing an image according to claim 40 further comprises a transfer roller for transferring said developer to said selected image-carrying medium based upon said selected image-carrying medium.

50. The apparatus for reproducing an image according to claim 49 wherein said medium selector varies a voltage applied to said transfer roller.

51. An apparatus for reproducing an image on one of a selected group of predetermined image-carrying media using a liquid carrier based developer containing toner particles and a liquid carrier, each of said predetermined image-carrying media providing varying image reproduction surface characteristics, said apparatus comprising:

a medium selector for selecting one of said predetermined image-carrying media, said one of said image-carrying media being a selected image-carrying medium;

a photoreceptor drum for holding said developer before placing said developer onto said selected image-carrying medium;

a developing roller located adjacent to said photoreceptor drum for applying onto said photoreceptor drum said developer according to said image to be reproduced, said toner particles being placed approximately at a predetermined range of distance at each other prior to transferring said developer; and a transfer roller located adjacent to said photoreceptor drum for applying a predetermined voltage to said developer from a predetermined distance through an air gap so as to transfer said developer from said photoreceptive drum onto said image-carrying medium based upon said selected image-carrying medium thereby transferring an appropriate amount of said developer based upon said selected image-carrying medium.

52. The apparatus for reproducing an image according to claim 51 wherein said developing roller applies an appropriate amount of said developer based upon said image-carrying medium.

53. The apparatus for reproducing an image according to claim 52 wherein said medium selector determines a first voltage to be applied to said developing roller.

54. The apparatus for reproducing an image according to claim 52 wherein said medium selector determines a ratio between said toner and said carrier liquid in said developer to be applied to said photoreceptor drum.

55. The apparatus for reproducing an image according to claim 51 wherein said medium selector determines a second voltage to be applied to said transfer roller.

56. The apparatus for reproducing an image according to claim 51 further comprises a liquid carrier reduction means for removing a first predetermined amount of said liquid carrier from said developer applied on said photoreceptor drum based upon said selected image-carrying medium.

57. The apparatus for reproducing an image according to claim 56 wherein said liquid carrier reduction means includes a reverse roller which physically contacts said developer on said photoreceptor drum.

58. The apparatus for reproducing an image according to claim 56 wherein said liquid carrier reduction means includes an air compressor which applies air towards said developer on said photoreceptor drum.

59. The apparatus for reproducing an image according to claim 51 further comprises a set roller for further removing a second predetermined amount of said carrier liquid on said photoreceptor drum based upon said selected image-carrying medium so as to reduce said predetermined range of distance between said toner particles.

60. The apparatus for reproducing an image according to claim 51 further comprises a set roller for reducing said predetermined distance between said toner particles.

61. The apparatus for reproducing an image according to claim 60 wherein said set roller removes said second predetermined amount of said carrier liquid substantially from a portion of said developer containing said toner.

62. An apparatus for reproducing an image on one of a group of image-carrying media using a liquid carrier based developer containing a liquid carrier and toner particles, each of said predetermined image-carrying media providing varying image reproduction surface characteristics, said apparatus comprising:

a medium selector for selecting one of said predetermined image-carrying media, said one of said image-carrying media being a selected image-carrying medium;

a photoreceptor drum for holding said developer before placing said developer onto said selected image-carrying medium;

a developing roller located adjacent to said photoreceptor drum for applying onto said photoreceptor drum said developer containing a first predetermined amount of said liquid carrier, said toner particles being placed at a predetermined range of distance from each other;

a reverse roller located adjacent to said photoreceptor drum for removing a second predetermined amount of said liquid carrier from said developer on said photoreceptor drum prior to transferring said developer onto said image-carrying medium;

a set roller located adjacent to said photoreceptor drum for applying a predetermined voltage to said developer from a predetermined distance through an air gap so as to further remove a third predetermined amount of said liquid carrier based upon said selected image-carrying medium prior to transferring said developer onto said image-carrying medium so as to reduce said predetermined range of distance between said toner particles; and a transfer roller located adjacent to said photoreceptor drum for transferring said developer from said photoreceptive drum onto said image-carrying medium based upon said selected image-carrying medium.

63. The apparatus for reproducing an image according to claim 62 wherein said developing roller applies said developer based upon said selected image-carrying medium.

64. The apparatus for reproducing an image according to claim 62 wherein said reverse roller removes said liquid carrier based upon said selected image-carrying medium.

65. A system of for reproducing an image on one of a selected group of predetermined image-carrying media using a liquid carrier based developer containing toner particles and a liquid carrier, each of said predetermined image-carrying media providing varying image reproduction surface characteristics, said system comprising:

a medium selector for selecting one of said predetermined image-carrying media, said one of said image-carrying media being a selected image-carrying medium;

a photoreceptor drum for holding said developer before placing said developer onto said selected image-carrying medium;

a developing roller located adjacent to said photoreceptor drum for applying onto said photoreceptor drum said developer for reproducing said image based upon said selected image-carrying medium, said toner particles being placed at a predetermined range of distance from each other;

a reverse roller located adjacent to said photoreceptor drum for removing a first predetermined amount of said developer from said photoreceptor drum based upon said selected image-carrying medium prior to transferring said developer onto said selected image-carrying medium; and a set roller located adjacent to said photoreceptor drum for applying a predetermined voltage to said developer from a predetermined distance through an air gap so as to further remove a second predetermined amount of said liquid carrier on said photoreceptor drum based upon said selected image-carrying medium so as to reduce said predetermined range of distance between said toner particles prior to transferring said developer onto said selected image-carrying medium, whereby a quality of said image on said selected image-carrying medium is optimized.

66. A system for reproducing an image on one of a selected group of predetermined image-carrying media using a liquid carrier based developer containing toner particles and a liquid carrier, each of said predetermined image-carrying media providing varying image reproduction surface characteristics, said system comprising:

a medium selector for selecting one of said predetermined image-carrying media, said one of said image-carrying media being a selected image-carrying medium;

a photoreceptor drum for holding said developer before placing said developer onto said selected image-carrying medium;

a developing roller located adjacent to said photoreceptor drum for applying onto said photoreceptor drum said developer for reproducing said image based upon said selected image-carrying medium prior to transferring said developer onto said selected image-carrying medium;

a reverse roller located adjacent to said photoreceptor drum for removing a first predetermined amount of said developer from said photoreceptor drum based upon said selected image-carrying medium prior to transferring said developer onto said selected image-carrying medium; and a transfer roller located near said photoreceptor drum for applying a predetermined voltage to said developer from a predetermined distance through an air gap so as to transfer said developer from said photoreceptive drum onto said selected image-carrying medium based upon said selected image-carrying medium.

67. A system for reproducing an image on one of a group of image-carrying media using a liquid carrier based developer containing a liquid carrier and toner particles, each of said predetermined image-carrying media providing varying image reproduction surface characteristics, said system comprising:

a medium selector for selecting one of said predetermined image-carrying media, said one of said image-carrying media being a selected image-carrying medium;

a photoreceptor drum for holding said developer before placing said developer onto said selected image-carrying medium;

a developing roller located adjacent to said photoreceptor drum for applying onto said photoreceptor drum said developer containing a first predetermined amount of said liquid carrier based upon said selected image-carrying medium, said toner particles contained therein being placed at a predetermined range of distance from each other;

a reverse roller located adjacent to said photoreceptor drum for removing a second predetermined amount of said liquid carrier from said developer on said photoreceptor drum based upon said selected image-carrying medium prior to transferring said developer onto said selected image-carrying medium;

a set roller located adjacent to said photoreceptor drum for applying a predetermined voltage to said developer from a predetermined distance through an air gap so as to further remove a third predetermined amount of said liquid carrier based upon said selected image-carrying medium so as to reduce said predetermined range of distance between said toner particles prior to transferring said developer onto said selected image-carrying medium; and a transfer roller located adjacent to said photoreceptor drum for transferring said developer from said photoreceptive drum onto said image-carrying medium on said transfer roller based upon said selected image-carrying medium.

* * * * *

UNITED STATES PATENT AND TRADEMARK OFFICE

CERTIFICATE OF CORRECTION

PATENT NO. : 5,652,080

DATED : July 29, 1997

INVENTOR(S) : Mie Yoshino, Makoto Obu and Takeo Tsukamoto

It is certified that error appears in the above-identified patent and that said Letters Patent is hereby corrected as shown below:

Column 4, line 56, change "places" to --placed--.

Column 11, line 40, change "1" to --ℓ--.

Column 11, line 43, change "1" to --ℓ--.

Signed and Sealed this

Twenty-fifth Day of November, 1997

*Attest:*

*Attesting Officer*

BRUCE LEHMAN

*Commissioner of Patents and Trademarks*